US005456437A

United States Patent [19]

Chander et al.

[11] Patent Number: 5,456,437

[45] Date of Patent: Oct. 10, 1995

[54] HOLDER FOR CANES, CRUTCHES AND THE LIKE

[76] Inventors: Radha K. Chander, 9908 Fairfax Sq. No. 149, Fairfax, Va. 22031; Maxwell Stander, 11512 Taber St., Silver Spring, Md. 20902

[21] Appl. No.: 273,801

[22] Filed: Jul. 12, 1994

[51] Int. Cl.[6] ..... A47G 1/10

[52] U.S. Cl. ..... 248/316.7; 211/62

[58] Field of Search ..... 248/113, 110, 248/316.7; 211/62, 63, 65, 66, 89

[56] References Cited

U.S. PATENT DOCUMENTS

| | | | |
|---|---|---|---|
| 42,833 | 7/1912 | Carlsson | 211/65 X |
| D. 301,976 | 7/1989 | Greenhut | 211/66 X |
| 1,050,519 | 1/1913 | Cox | 211/62 |
| 2,733,030 | 1/1956 | Hawthorne | 248/536 X |
| 4,605,190 | 8/1986 | Kamp | 248/316.7 |
| 5,050,830 | 9/1991 | Hall | 248/316.7 X |

*Primary Examiner*—J. Franklin Foss

[57] ABSTRACT

The invention comprises a clamp forming part of a vertical member that is pivotally attached to a flat plate. The clamping portion holds the cylindrical or rectangular section of a cane, crutch and the like in a temporary fixed upright position with the article resting on the floor or ground. The bottom surface of the plate and the back lower part of the vertical member are lined with elastomeric non-skid surface pads. The plate is pivoted so that it can be placed on a horizontal surface such as a table top or a bench so that the non-skid surface of the plate and the back of the vertical member hold the article in an essentially vertical position. To station the article against a vertical surface, the plate is rotated so that is essentially parallel to and resting against the vertical surface. This will also be the position when the holder is not in use. The clamp can remain attached to the article at all times or easily removed, if desired. The holder is lightweight, compact, inexpensive to manufacture, and is not permanently attached to the article or a fixed surface. The holder provides the user of the article to quickly and temporarily place the article within reach on a table, bench or against the wall.

2 Claims, 1 Drawing Sheet

HOLDER FOR CANES, CRUTCHES AND THE LIKE

BACKGROUND

The invention relates to a portable, lightweight holder that quickly engages the shaft of a cane, crutch or the like, and remains temporarily attached to the article. The article, with attached holder can then be held in an essentially upright position on a table, counter-top, desk or against a wall.

In prior art (U.S. Pat. Nos. 42833; 1,050,519; 2,733,030 and D301,976), the cane, crutch or the like is held in place by clamping the members that are mechanically attached by fastening means to fixed surfaces, and lack portability and convenience. In U.S. Pat. No. 4,605,190 the holder is placed against a horizontal surface parallel to the ground, and uses adhesive means to provide gripping action. U.S. Pat. No. 4,605,190 is deficient in that it is limited to a horizontal surface; the adhesive medium picks up foreign matter thereby losing its adhesive strength during the course of its usage and is likely to mar the resting surfaces.

The subject invention is a portable and versatile device designed to overcome the aforementioned deficiencies in the prior art.

SUMMARY OF THE INVENTION

In the preferred embodiment of the invention, the holder comprises a clamp forming part of a vertical member that is pivotally attached to a flat plate. The clamping portion holds the cylindrical or any cross section of a cane, crutch and the like in a temporary, fixed, upright position with the article resting on the floor or ground. The bottom surface of the plate and the back, lower part of the vertical member are lined with elastomeric, non-skid surface pads. The plate is pivoted so that it can be placed on a horizontal surface such as a table or a bench so that the non-skid surfaces of plate and back of the vertical member retain the article in an essentially vertical position. To station the article against a vertical surface, the plate is rotated so that it is essentially parallel to the vertical surface. This will also be the position when the holder is not in use. The clamp can remain attached to the article at all times, or easily removed, if desired. The holder is lightweight, compact, inexpensive to manufacture and is not permanently attached to the article or a fixed surface. The holder provides the user of the article to quickly and temporarily place the article within reach on a table, bench, or against a vertical surface.

BRIEF DESCRIPTIONS OF DRAWINGS

DETAILED DESCRIPTION OF PREFERRED EMBODIMENTS

The invention pertains to a portable, compact holder for canes, crutches, or the like that is not permanently attached to either the article or any surface. In the prior art, holders for these articles require racks or are mechanically attached or mounted to the article or fixed surface for grasping the article. In the preferred embodiment of this invention, the holder uses simple construction, is not mechanically attached to any surface, can be temporarily retained on the article or easily removed, and can be quickly and conveniently used on horizontal or vertical surfaces.

Figure 1:
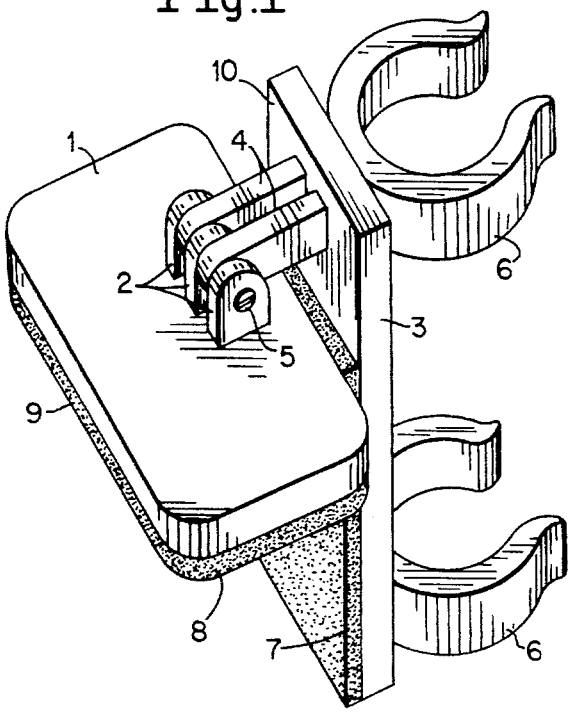
FIG. 1 is perspective view of the holder
Figure 2:
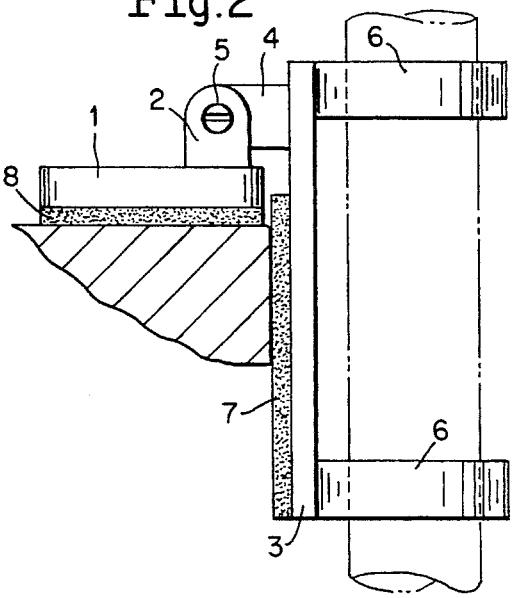
FIG. 2 is a side elevation taken from the right of FIG. 1, side elevation taken from the left of FIG. 1 being identical
Figure 3:
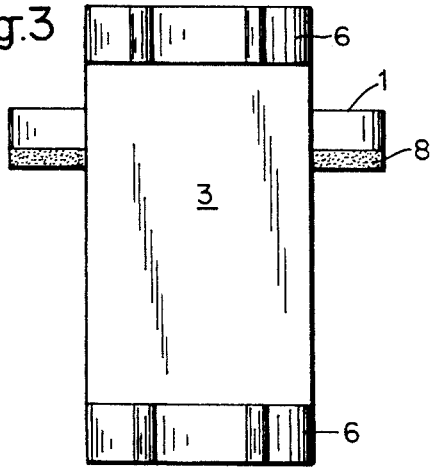
FIG. 3 is front elevation
Figure 4:
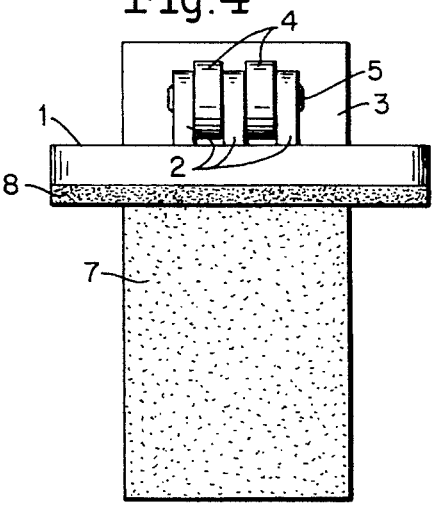
FIG. 4 is rear elevation
Figure 5:
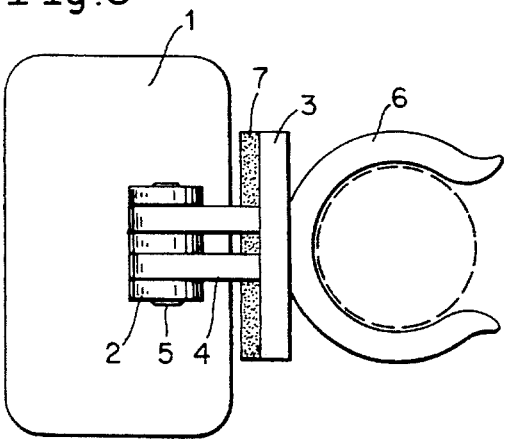
FIG. 5 is a top view with the plate in a horizontal plane
Figure 6:
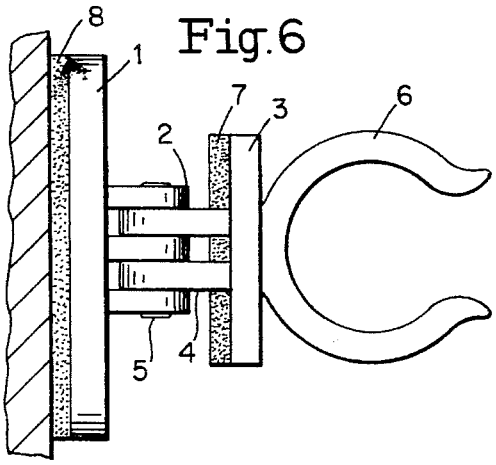
FIG. 6 is a top view with the plate in a vertical plane

Reference is made to FIGS. 1, 2, 4 and 5 in which the invention is shown in use on a horizontal surface such as a table, desk or bench. The article comprises a rigid movable flat plate 1 from which hinge walls 2 project orthogonally from the upper surface. The rigid vertical member 3 has hinge walls 4 that are integrally molded, and project orthogonally from the back surface and mate with the corresponding hinge walls 2 to which they are attached by the connecting pin 5. This forms a hinge that permits the flat plate to pivot from a position essentially normal to the vertical member 3, to a position essentially parallel to the vertical member 3. The front portion of the vertical member 3 contains semi-rigid clamps 6 shown in FIGS. 1, 2, 3,5 and 6 that grip the rod like article. The elastomeric non-skid pads 7 and 8 prevent the holder from sliding across the horizontal or vertical surfaces while the clamps 6 retain the article in an essentially vertical position. When placed on a horizontal surface, the flat plate 1 is retained in an essentially horizontal position since the front surface 9 of the flat plate 1 impinges on the elastomeric non-skid pad 7 on the rear surface 10 of the vertical member 3. In FIG. 6, the movable flat plate 1 is moved to a position parallel to the vertical member 3 so that the elastomeric non-skid pad 7 rests against a vertical surface.

We claim:

1. A holder for canes, crutches and the like comprising:

(A) a vertical member with a spring-like clamp means for clasping a cylindrical or a rectangular rod-like member;

(B) hinge means pivotally joining the clamp on the vertical member to a flat plate at the base of which is applied an elastomeric non-skid surface;

(C) the lower rear part of the said vertical member to which an elastomeric non-skid surface is applied;

(D) hinge means pivotally joining the said vertical member with the clamp portion and said flat plate, said hinge means permitting movement to two positions, one at 90-degrees so that the said flat plate can rest on a horizontal surface, and the other at 0-degree so that the said flat plate can rest against a vertical surface;

(E) and wherein the said clamp comprises a swing lock mechanism engaging means.

2. The holder according to claim 1 in which the said hinges and said clamps are mechanically fastened to the said flat plate and said vertical member.

* * * * *